United States Patent [19]

Habibi

[11] Patent Number: 4,893,132

[45] Date of Patent: Jan. 9, 1990

[54] ASSEMBLY SYSTEM FOR MAINTAINING REFLECTOR SEGMENTS OF AN ANTENNA IN PRECISION ALIGNMENT

[75] Inventor: Farhad M. Habibi, Sterling, Va.

[73] Assignee: Radiation Systems, Inc. Technical Products Division, Sterling, Va.

[21] Appl. No.: 263,944

[22] Filed: Oct. 28, 1988

[51] Int. Cl.[4] ..... H01Q 15/20

[52] U.S. Cl. ..... 343/912; 343/840; 343/915

[58] Field of Search ..... 343/781 P, 781 CA, 781 R, 343/840, 910, 912, 915, 916

[56] References Cited

U.S. PATENT DOCUMENTS

| | | | |
|---|---|---|---|
| 1,558,184 | 10/1925 | Kluender | 403/353 |
| 3,174,397 | 3/1965 | Sanborn | 343/915 |
| 3,197,934 | 8/1965 | Brown | 52/595 |
| 3,715,760 | 2/1973 | Palmer | 343/915 |
| 3,731,445 | 5/1973 | Hoffmann et al. | 52/391 |
| 4,315,265 | 2/1982 | Palmer et al. | 343/840 |
| 4,447,171 | 5/1984 | Baldoni et al. | 403/381 |
| 4,504,168 | 3/1985 | Miller | 403/353 |
| 4,642,652 | 2/1987 | Herbig et al. | 343/915 |
| 4,710,777 | 12/1987 | Halverson | 343/840 |

FOREIGN PATENT DOCUMENTS 0049709 3/1987 Japan .

*Primary Examiner*—Rolf Hille
*Assistant Examiner*—Doris J. Johnson
*Attorney, Agent, or Firm*—Pollock, Vande Sande & Priddy

[57] ABSTRACT

Antenna reflector mounting system for rapidly supporting reflector segments in precise alignment. A multifaceted hub member is provided, each face of the hub member defining a rectangular opening of a cavity. A rod is located at the base of each cavity, supported between two walls thereof. A tongue member connected to the narrow end of an antenna segment is inserted in the cavity. The tongue member has a portion extending out from the connected antenna segment and downwardly at an angle. Once the tongue member is inserted over the rod, the distant end of the segment may be rotated vertically. Rotation of the tongue member about the rod pulls the connected antenna segment into alignment with the hub member.

10 Claims, 4 Drawing Sheets

16
16a
17
19
21
22
25
25a
27
32
34
36
37
39
45
46
47
48

ASSEMBLY SYSTEM FOR MAINTAINING REFLECTOR SEGMENTS OF AN ANTENNA IN PRECISION ALIGNMENT

The present invention relates to the manufacture of reflector antennas. Specifically, a system is provided for precisely and rapidly mounting segments of a reflector segment in alignment so that mechanical discontinuities which adversely affect reflector performance are minimized.

Reflector antenna systems are used throughout the communication industry. These antenna systems are found in most earth stations wherein communications between synchronous or orbital satellites is maintained. Additionally, in many applications, point to point communications make use of reflector antenna systems having a reflector concentrating the incident receive signal to a focus where it can be collected and distributed to a receiver. The reflector antennas are bi-directional for transmitting radio frequency signals to a distant receive station.

The performance of a reflector antenna is largely a function of its surface accuracy. The surface in most cases is formed to represent a parabolic surface with a feed for removing the concentrated energy at the focus. In metal fabrication techniques, it is difficult to maintain a surface accuracy over a large surface area. Additionally, because of the wavelengths of microwave signals and the need for high antenna gain, the reflectors tend to be large, having diameters anywhere from 5 or 6 feet to several hundred feet. The physical requirements for such parabolic reflectors requires that they be built in segments, each segment representing a slice of the entire desired parabolic reflector surface. These segments make it possible to manufacture the reflector in quantities, while also permitting the antenna, when disassembled, to be stored in a convenient storage and shipping package.

Putting such reflector segments together in a final assembly so that the resulting surface has negligible discontinuities, involves considerable skill and practice on the part of the assembly team. The antenna segments must be assembled so they are precisely aligned to avoid any surface discontinuities which may affect the reflector performance. In many applications, such as in a transportable operation the antenna is subject to constant assembly and reassembly, and it becomes especially difficult to efficiently assembly and erect such a parabolic structure while maintaining the required surface accuracy. In many assemblies, precise measuring instruments, such as transits and theodolites are needed to check the alignment of each of the segments forming the completed surface. For transportable applications, the need for a rapid assembly is paramount, and assembly procedures which are tediuous are most undesirable.

The present invention has been provided in order to provide quick assembly of such parabolic antennas, while at the same time maintaining the desired surface accuracy for the assembled reflector surface.

SUMMARY OF THE INVENTION

It is an object of this invention to provide a system for rapidly assembling while still maintaining precisely aligning segments of a reflector antenna.

It is a more specific object of this invention to provide a system which will maintain reflector segments in precision alignment without the need for accurate measuring instruments or special assembly procedures or tools.

These and other objects are provided by an antenna reflector mounting system which supports reflector segments in precise alignment. In this system, a master hub member is used to fasten the narrow ends of each reflector segment together in precise alignment. The remaining ends of the reflector assembly are maintained in accurate alignment with other segment members by conventional aligning pins and latching components.

In the mounting system of the present invention, each narrow end of the reflector segment includes a tongue member configured to be received in a cavity of the master hub member. The tongue member is inserted by lowering the distant end of the reflector segment to permit insertion of the tongue member in one of a plurality of cavities of the master hub member. Each of these cavities have an axis which crosses at the geometric center of the reflector structure.

The cavity includes, at the entrance, a horizontal bar member over which the tongue is inserted. By raising the distant end of the reflector segment, the tongue rotates about the bar member, pulling the tongue and attached antenna segment into its aligned position so that the axis of the antenna segment is coincident with the axis of the cavity.

Once the distant end of the antenna reflector segment has been vertically raised, the tongue and horizontal bar have pulled the segment into its final position. Alignment pins and mating sockets are located on facing edges of the reflector segment accurately positioning the segments at their distant ends. Latches on the edges of the distant end of the reflector segment are coupled with matching latch members on the adjacent antenna reflector segment, thus holding the reflector segments in precise alignment with each other.

Using the foregoing system, it is possible without any tools or aligning equipment to insert each segment and its attached tongue into the master hub assembly, pivot the same into its final position and then latch it to an adjacent antenna reflector member. This system considerably reduces the amount of time needed to erect an antenna system while establishing a precise fit so that the assembled reflector has an RF performance which is comparable with other systems needing much more precise and elaborate assembly procedures.

DESCRIPTION OF THE PREFERRED EMBODIMENT

Figure 1:
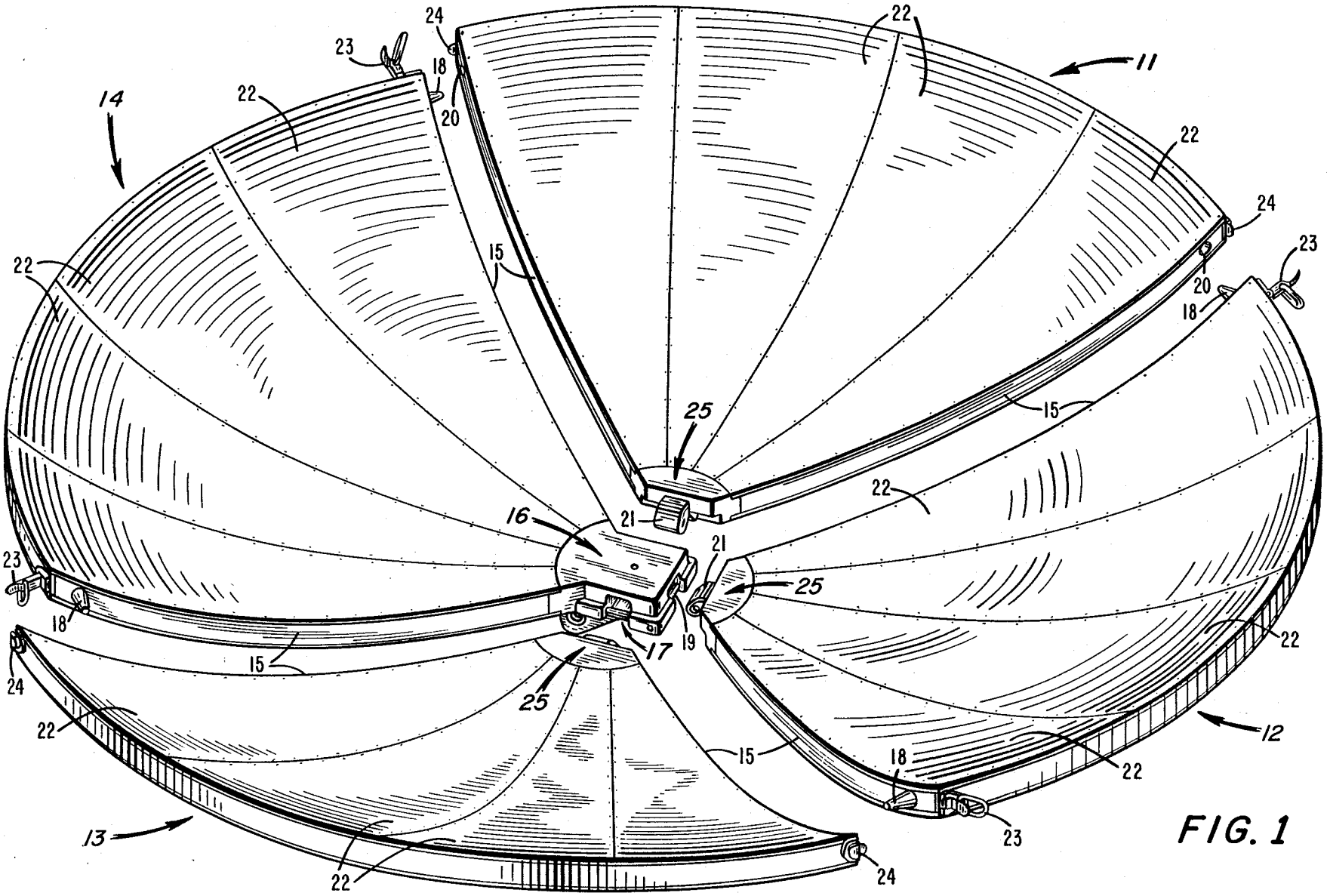
FIG. 1 illustrates an embodiment of the present invention for assembling segments of an antenna reflector.

Referring now to FIG. 1, there is shown a number of reflector segments 11, 12, 13 and 14 which are assembled together to form a uniform reflector assembly. Those familiar with these antenna structures will recognize that they usually include a bipod or tripod structure for supporting a feed at the focus of the reflector assembly. This structure has been omitted as a matter of clarity in describing how the present invention permits quick and accurate assembly of the segments 11, 12, 13 and 14 into precise alignment with each other.

One of the shown segments 14 includes on the narrow end thereof a hub member 16. The hub member 16 has three perpendicular faces which have an axis intersecting at the geometric center of the desired parabolic surface. Each of the three faces include a cavity 17 with an axis aligned to cross at the geometric center.

Each reflector segment 11, 12, 13 and 14 comprises a number of skins 22, attached by riveting or other suitable fastening means to backing structure or ribs 15. The ribs 15 all originate from a casting 25, which positions the ribs so that the skins 22 nearly abut each other to avoid any surface discontinuities which would interfere with the radio frequency performance of the reflector. Connected to the casting 25 is a tongue member 21. The tongue member 21, as will be explained in greater detail in subsequent Figures, is positioned to extend outwardly and then downwardly at an angle from the surface of casting 25 which ultimately faces the surface of hub member 16 when finally assembled. As FIG. 1 illustrates, each of the faces of hub member 16 includes a cavity 17 receiving the tongue member 21. Additionally, a horizontal bar 19 is shown over which the tongue member is initially inserted. As will also be clear from the subsequent discussion of the Figures, the distant end of each reflector segment 11, 12, 13 and 14 is lowered to permit entry of the tongue member 21 in the cavity 17. Subsequent raising of the distant end of the segment member will result in the tongue member and horizontal bar 19 cooperating so that the narrow end of each reflector segment is drawn into the hub member 16, accurately positioning each narrow end of the antenna segments 11, 12, 13 and 14 with respect to the geometric center of the desired parabolic shape.

Having successfully positioned each antenna segment narrow end with respect to the geometric center of the parabola. The aligning pins 18 and sockets 20 position the distant ends of the antenna segments accurately with respect to each other. It is possible with latches 23 and latching member 24 to latch the distant end of the reflector segments in position with respect to each other.

Figure 2:
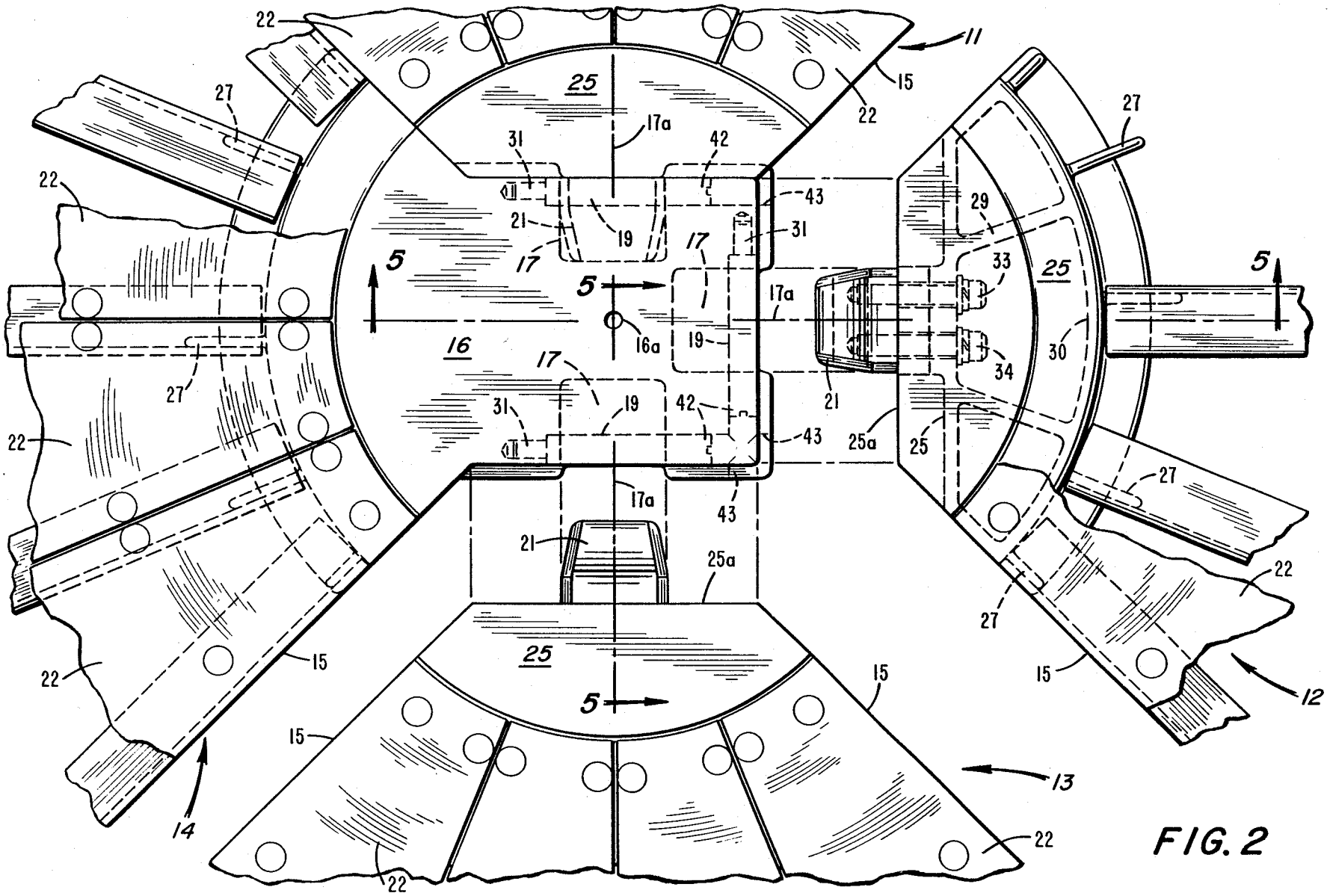
FIG. 2 is a top view of the hub assembly 16 and a related cooperating end 30 of a reflector segment 12.

FIG. 2 is a top view of hub assembly along with the adjacent view of an antenna segment 12 and 13. The hub member 16 can be seen to include three cavities 17, each orthogonally spaced so that the axis thereof crosses at the geometric center 16*a*. Each axis 17*a* is aligned with an axis of each reflector segment 12 and 13. Also shown is the horizontal bar 19 which is placed adjacent the lower edge of the cavity 17 through a hole 43. The horizontal bar 19 comprises a shaft slotted at one end and having an opposite threaded end received in a like threaded hole in the casting 25.

The tongue member 21 is shown assembled to the casting 25 by virtue of two bolts 33 and 34, which through corresponding tapped holes in the tongue member 21, accurately and rigidly connect the tongue member 21 to the casting 25. The casting 25 includes reinforcing members 29 and an outer circumferential rib 30 which supports each of a plurality of aligning tabs 27. These aligning tabs 27 permit the ribs 15 to be accurately positioned along the casting 25.

The details of the ribs 15 and skin 22 structure are conventional, having been used in reflector manufacturing long prior to the present invention.

The hub member 16, like the casting 25, may either be a casting or machined part, and includes aligning tabs 27 integral therewith, which permit a plurality of rib members 15 and skin structure to be connected with the hub member 16.

Figure 3:
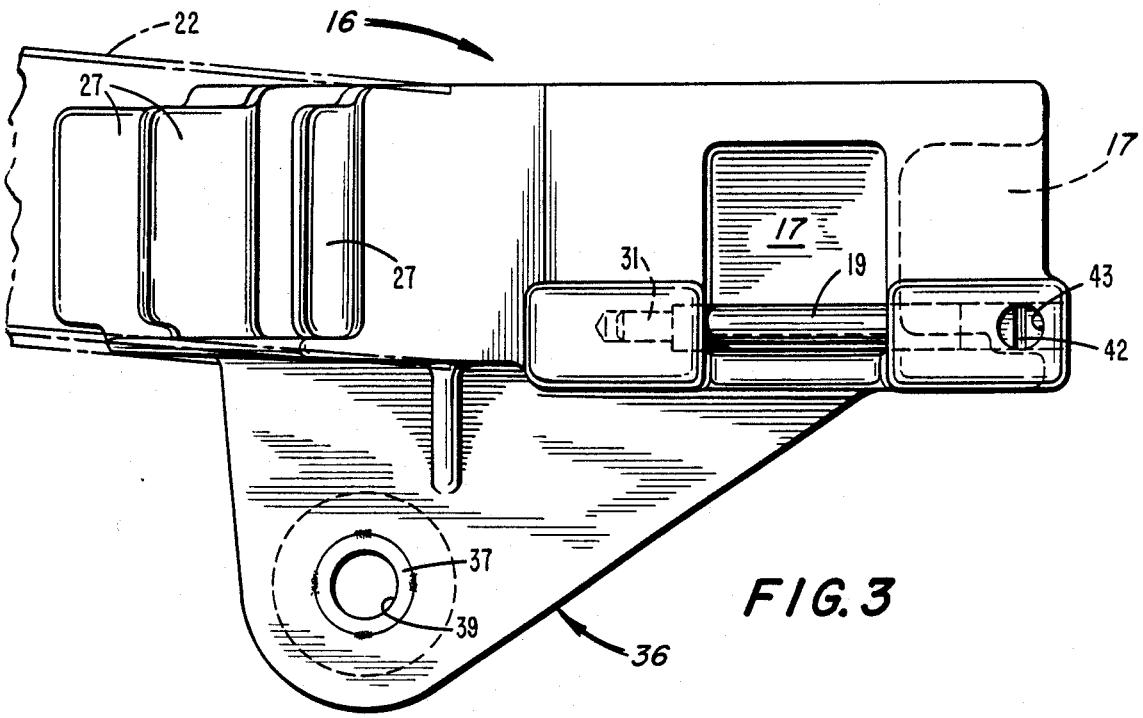
FIG. 3 is a side view of the hub member 16 of FIG. 2.
Figure 4:
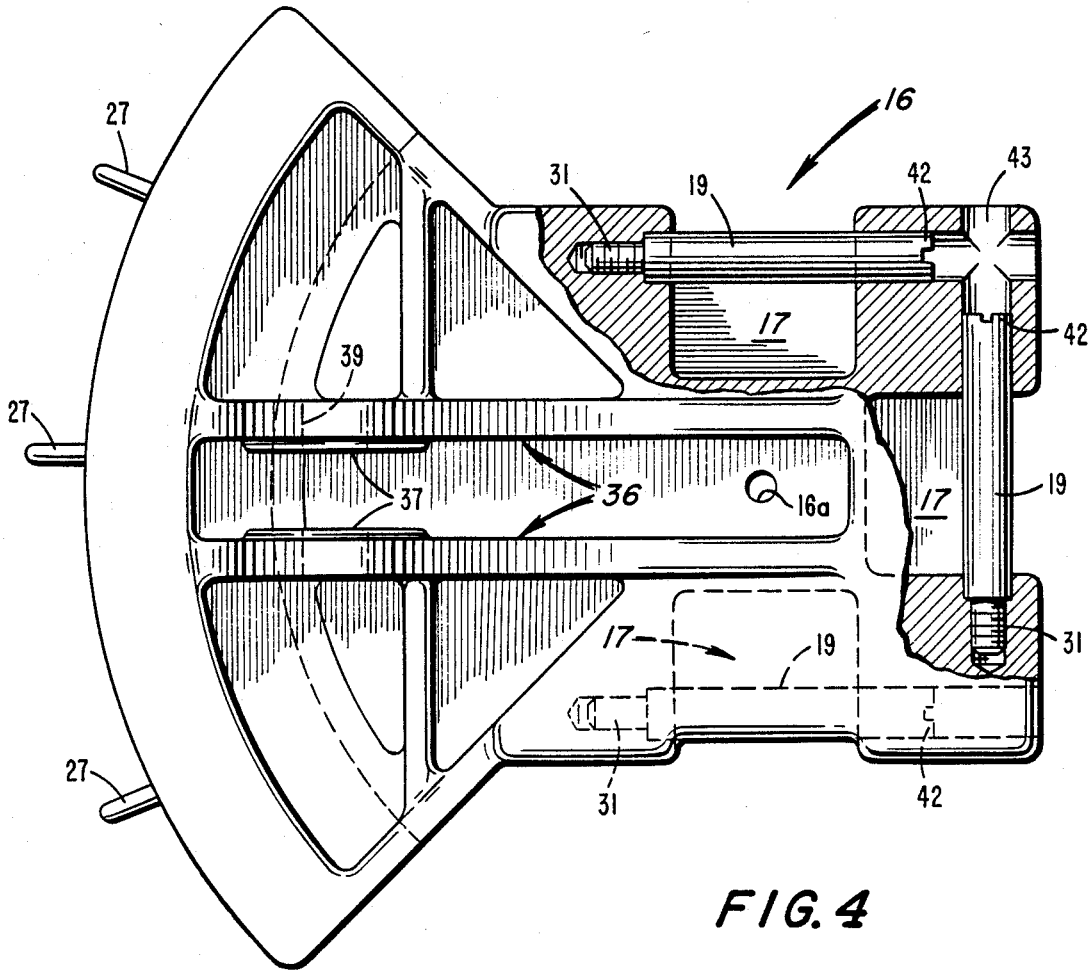
FIG. 4 is a bottom view of the hub member 16 of the embodiment of FIG. 2.

Referring now to FIG. 3, it is clear that the cavity 17 includes at the bottom thereof the horizontal bar member 19. Additionally, the slot in horizontal bar 42 can be seen through the requisite hole 43. FIG. 4 illustrates the top view of this structure in greater detail. At the bottom of the hub member is an extending reflector support 36. This support, when the antenna reflector surface is completely assembled, will permit the mounting of the reflector structure, through a single clevis pin, through hole 39, and bearing surface 37 to a conventional elevation actuator. As seen in FIG. 4, the support comprises an extending flange 36 having a pair of side walls spaced apart. The clevis pin can be inserted through the aperture 39 to connect the center of the reflector structure to the elevation actuator. In the erect position, the lower edge of the reflector antenna is pivotally supported on a base, such that the elevation actuator can change the tilt angle of the antenna.

Figures 5, 5A, 5B, 5C:
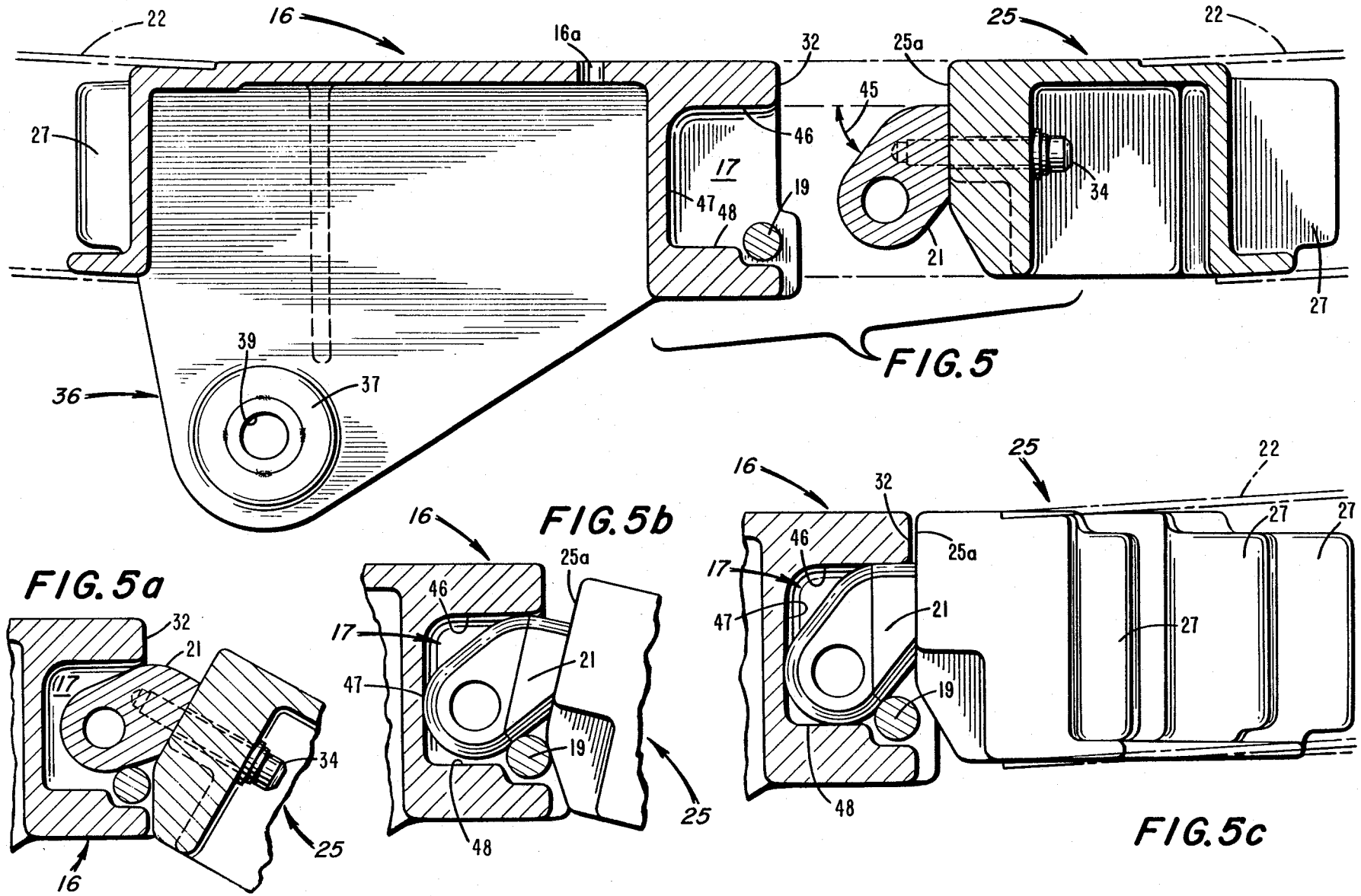
FIG. 5 is an illustration of the tongue member 21 as it relates to its receiving cavity 17.
FIGS. 5A, 5B and 5C illustrate the sequence of operations for assembling a reflector segment to the master hub member 16.

In FIG. 5 it can be seen in greater detail how the tongue 21 is formed with respect to the cavity 17 and casting 25. As can be seen from this Figure, tongue member 21 extends from the casting 25 perpendicularly and then at an angle 45, which may be 52°, terminating in a radiused end. The cavity 17 includes surfaces 46, 47 and 48 which will contact the tongue 21 to maintain the tongue 21 and its connected antenna segment 27 in accurate alignment with the hub member 16. This three point contact, supplemented by a fourth contact between the tongue and horizontal rod 19 has been found to be advantageous in maintaining precise alignment. However, it will be evident that other embodiments of the invention may use less than 4-point contact and still achieve sufficiently accurate alignment.

The assembly and operation of the mounting system can be more clearly seen from FIGS. 5A, 5B and 5C. In FIG. 5A, the tongue 21 is inserted in the cavity 17 by lowering the distant, wider end of the reflector segment. When the reflector segment is inclined at the angle shown in FIG. 5A, the tongue 21 will be positioned over the horizontal rod 19. As is shown in FIG. 5B, as the distant end of the reflector segment is vertically raised, the tongue member 21 will pivot over the horizontal bar 19, at the same time drawing in the reflector segment. Continued rotation of the antenna segment in the vertical direction will bring surface 25*a* of casting 25 almost flush with the surface 32 of the hub member. In this final assembled position, the tongue 21 will be seen touching at three points along the interior of the cavity 17. These represent contact along wall 46, the opposite wall 48 and a wall 47 perpendicular to walls 46 and 48. Contact along the surface of the horizontal rod 19 is also provided.

Thus, it is seen from FIGS. 5A, 5B and 5C the narrow end of the reflector segment may be positioned to be drawn into the hub member in its final fixed position having little play, and accurately fixed with respect to the hub 16. Once the alignment pins 18 and sockets 20 are mated, the edges of adjacent reflector segments are aligned. The latch and latching members 23 and 24 of the distant end of the reflector segment may then be coupled, holding the reflector segments in their final assembled position.

The foregoing assembly procedure requires no special optical instruments, nor any tools. It has been found in practice that 8-foot reflectors having only four segments may be erected in very minimal time of approximately 5 minutes or less. Although shown as applying to only four segments, it is obvious that the invention could include more than four segments for much larger reflector structures.

As can be appreciated the foregoing structure permits the antenna to be assembled and disassembled into a package size which will permit storage and removal to other locations.

Thus, there has been described an antenna mounting system which will permit convenient reflector segment sizes to be assembled into one reflector having a precise reflecting surface. Those skilled in the art will recognize yet other embodiments described by the claims which follow.

What is claimed is:

1. An antenna reflector mounting system for supporting reflector segments in precise alignment comprising:

a master hub member attached at one end thereof to a narrow end of one of said reflector segments, said hub member including a plurality of surfaces equal in number to a remaining number of said reflector segments, aligned along an axis of support of the remaining segments, each of said facing surfaces including:

a central cavity having a rectangular cross-section open to receive a tongue member connected to one of said remaining segments in alignment with an axis thereof, said cavity including adjacent said opening a supporting horizontal bar located adjacent a lower edge of said central cavity;

a tongue member connected in alignment with each of a remaining reflector segment, said tongue member extending downwardly from a connected reflector segment at an angle thereto, said tongue member having a distal end for insertion over said horizontal bar when said reflector segment is inclined downward from its normally aligned position, said tongue member pivoting about said horizontal bar when said reflector segment is raised pulling said antenna segment inward to said aligned position; and, means on a wide end of each antenna segment for holding said segment into alignment with an adjacent segment.

2. The antenna mounting system of claim 1 further including an extending clevis pin support connected to said hub member rear side for connecting said hub member and connected segments to an antenna elevation drive.

3. The antenna mounting system of claim 1 wherein said tongue member has a portion adjacent a connected reflector segment which extends horizontally in facing contact with a first wall of said cavity when said antenna segment is aligned with said mounting hub.

4. The antenna mounting system of claim 3 wherein said tongue member projects horizontally from said antenna segment to contact a surface of said cavity perpendicular to said first wall.

5. An antenna reflector mounting system for maintaining a plurality of antenna reflector segments in alignment with each other comprising:

a multifaceted hub member, each face of said hub member defining a rectangular opening of a cavity, each opening having a central axis intersecting at a common point with the axes of remaining cavities;

a rod located in each opening between a pair of walls of said cavity, and adjacent a wall perpendicular to said pair of walls; and, a tongue member connected to each antenna segment, said tongue member having a first horizontally extending portion, and a second portion extending downward at an angle to said first horizontal portion and having a rounded distal end, whereby said tongue is received in said cavity by downwardly tilting said connected antenna segment, and pivots about said rod pulling said antenna segment into alignment with said hub member.

6. The antenna reflector mounting system of claim 5 wherein said tongue member contacts one wall of said cavity along said first horizontally extending portion, and contacts two additional walls of said cavity at different points along said rounded distal end when said antenna segment is in alignment with said hub member.

7. The antenna reflector mounting system of claim 6 further comprising means for holding said antenna segments into alignment with each other.

8. The antenna reflector system of claim 7 wherein said hub member is permanently attached to one antenna segment.

9. The antenna reflector system of claim 6 wherein said tongue is detachably connected to said antenna segment.

10. The antenna reflector mounting system of claim 5 wherein said tongue member contacts said rod and two walls of said cavity when said antenna segment is in alignment with said hub member.

* * * * *